US005291211A

United States Patent [19]

Tropper

[11] Patent Number: 5,291,211

[45] Date of Patent: Mar. 1, 1994

[54] A RADAR ANTENNA SYSTEM WITH VARIABLE VERTICAL MOUNTING DIAMETER

[76] Inventor: Matthew B. Tropper, 168 Island Pkwy. W., Island Park, N.Y. 11558

[21] Appl. No.: 979,333

[22] Filed: Nov. 20, 1992

[51] Int. Cl.[5] ..... H01Q 1/12

[52] U.S. Cl. ..... 343/890; 343/700 MS; 343/879

[58] Field of Search ..... 343/700 MS, 757, 878, 343/879, 890, 891, 880, 892; 248/670, 176, 187

[56] References Cited

U.S. PATENT DOCUMENTS

| | | | |
|---|---|---|---|
| 2,436,843 | 3/1948 | Watts, Jr. et al. | 343/846 |
| 2,847,671 | 8/1958 | Lieb | 343/833 |
| 4,031,536 | 6/1977 | Alford | 343/890 |
| 4,349,824 | 9/1982 | Harris | 343/700 |
| 4,899,162 | 2/1990 | Bayetto et al. | 343/700 |
| 4,962,383 | 10/1990 | Tresselt | 343/700 |
| 5,039,992 | 8/1991 | Lenormand et al. | 343/705 |

OTHER PUBLICATIONS

U.S. Statutory Invention Registration, Reg. No. H966, published Sep. 3, 1991, Waters et al.

*Primary Examiner*—Donald Hajec
*Assistant Examiner*—Hoanganh Le
*Attorney, Agent, or Firm*—Jay H. Maioli

[57] ABSTRACT

A lightweight, nonmotorized radar antenna system specially adapted for use on a boat or ship includes a multiple section mount supporting a plurality of radiating elements to provide 360 degree coverage around a vertical structure, such as sailboat mast. The mount can have a variable inner diameter for installation on various sized structures.

3 Claims, 10 Drawing Sheets

A RADAR ANTENNA SYSTEM WITH VARIABLE VERTICAL MOUNTING DIAMETER

BACKGROUND OF THE INVENTION

1. Field of the Invention

The present invention relates to a lightweight, nonmotorized antenna system specially adapted for use on a boat or ship.

2. Description of Prior Art

Radar is widely used on both commercial and pleasure water craft of all sizes and motive means. Regardless of the type or size of the vessel, all marine radar sets are composed of the same basic building blocks, namely: the display, the data processing unit, the transceiver, and the antenna unit. One example of such a known marine radar set is shown in FIG. 1. In operation, the data processing unit 6 creates an electrical signal that is fed to the transceiver 8, and the transceiver 8 then feeds the signal through a coaxial cable 10 and a rotary joint 12 to the antenna 14. This signal is radiated from the antenna 14 in the form of an electromagnetic wave that propagates away from the antenna 14 until it encounters a solid object and is reflected. The antenna 14 then intercepts the reflected electromagnetic wave and converts it back into an electrical signal, which is fed back through the rotary joint 12 and the coaxial cable 10 to the transceiver 8. The transceiver 8 then communicates to the data processing unit 6 that the reflected signal has been received and the data processing unit 6 computes the distance and bearing of the solid object causing the reflection and produces information to be displayed on the display screen 16. Conventional marine radar antennas, such as antenna 14 in FIG. 1, are mounted on motorized mounts 18 that rotate the antenna in order to effectuate circular coverage. When such motorized mounts are employed, the resulting antenna/mount unit is substantially heavier than the antenna by itself. Nevertheless, these marine radar antennas must still be mounted as high as possible in order to maximize the range of the radar set.

Therefore, not only does the added weight of the motorized mount present a hazard and danger to the installer when the antenna unit is being mounted high upon a mast or support structure, but the extra weight of the motorized mount on its support structure can produce unnecessary, uncomfortable, and possibly even dangerous rolling motion upon the vessel.

Additionally, because motorized mounts are exposed to the elements, they are liable to rust and wear, especially when used in a high humidity environment as is encountered on the water. Such rust and wear inevitably result in requiring frequent preventive and corrective maintenance.

Finally, and significantly, when these motorized mounts are mounted to the mast of a sailboat, they are by necessity mounted either in front of, behind, or to the side of the mast. When positioned in this manner, the mast blocks radar coverage in a given segment of space. As shown in FIG. 2, mast 20 is mounted upon deck 22 of a vessel and motorized antenna 27 is mounted on horizontal member 23 in front of mast 20. Blind area 25 represents the segment of space that can not be scanned by motorized antenna 27.

OBJECTS AND SUMMARY OF THE PRESENT INVENTION

It is, therefore, one object of the present invention to provide a radar antenna unit that does not require the use of a heavy motorized mount; thus saving weight and resulting in an easier, safer installation. Such weight savings will also result in less rolling of the vessel because a lighter weight will have been installed at the top of a long lever arm, that is, the mast or the antenna support structure.

It is a further object of the present invention to provide a radar antenna unit that does not require the use of a breakdown-prone and electrically noisy motorized mount, which typically employs a motor and a rotary joint.

It is a still further object of the present invention to provide a radar antenna unit that provides unobstructed 360 degree coverage around an obstruction such as a mast.

In accordance with one aspect of the present invention, there is provided a radar antenna unit that is lightweight, nonmotorized, simple, sealed and capable of providing unobstructed radar coverage around an obstruction. Lightweight, low profile antenna elements such as microstrip antennas are mounted around the perimeter of a multi-piece mount. This multi-piece mount is then mounted by a friction fit around an obstruction, such as a sailboat mast, thereby providing a radar antenna unit with 360 degree coverage around the obstruction without resort to the use of a motorized mount or a rotary joint.

Other features and advantages of the present invention will become apparent from the following description, which is to be read in conjunction with the accompanying drawings in which like reference numerals represent the same or similar elements.

DETAILED DESCRIPTION OF PREFERRED EMBODIMENTS

Figure 1:
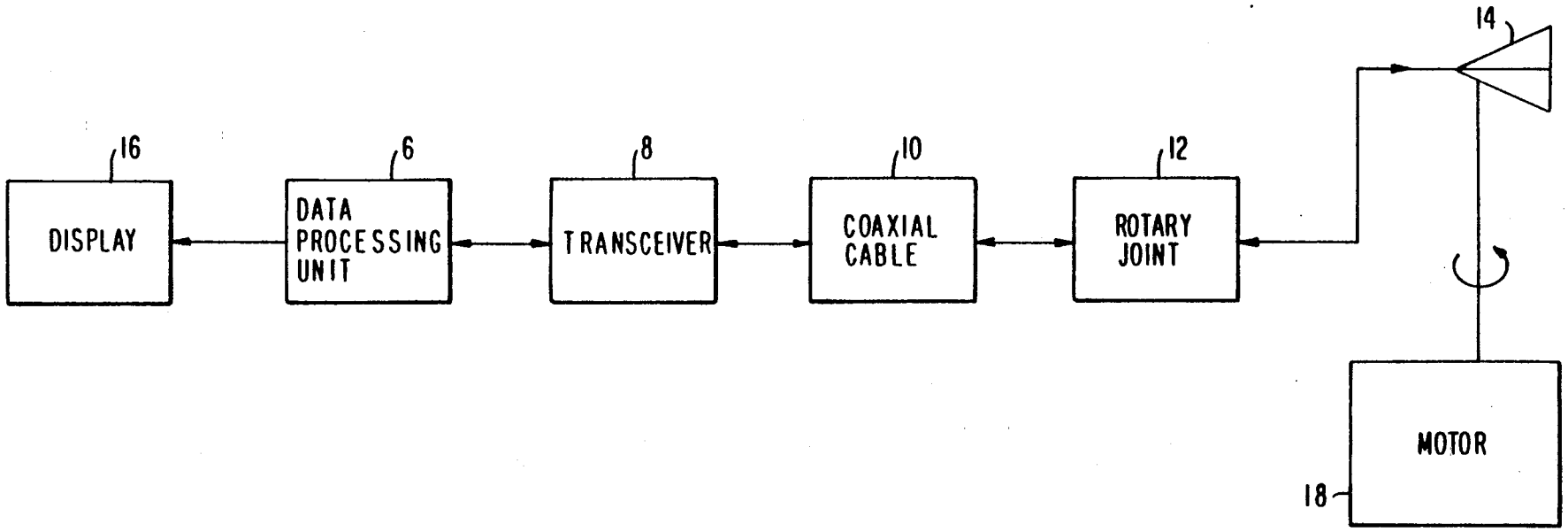
FIG. 1 PRIOR ART
FIG. 1 is a schematic of a conventional marine radar system.
Figure 2:
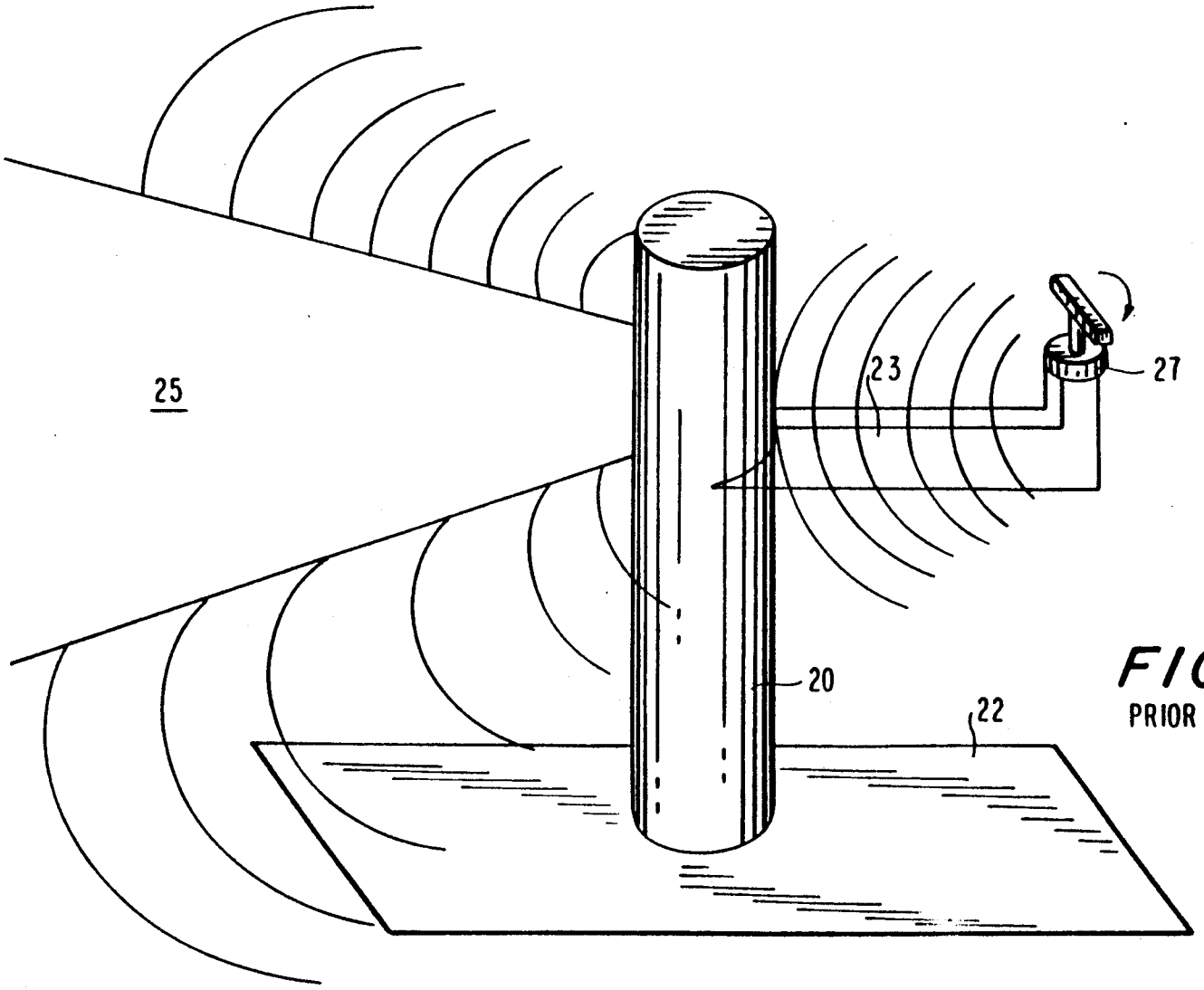
FIG. 2 PRIOR ART
FIG. 2 is a perspective view showing obstructed radar coverage provided by a conventional radar antenna system.
Figure 3:
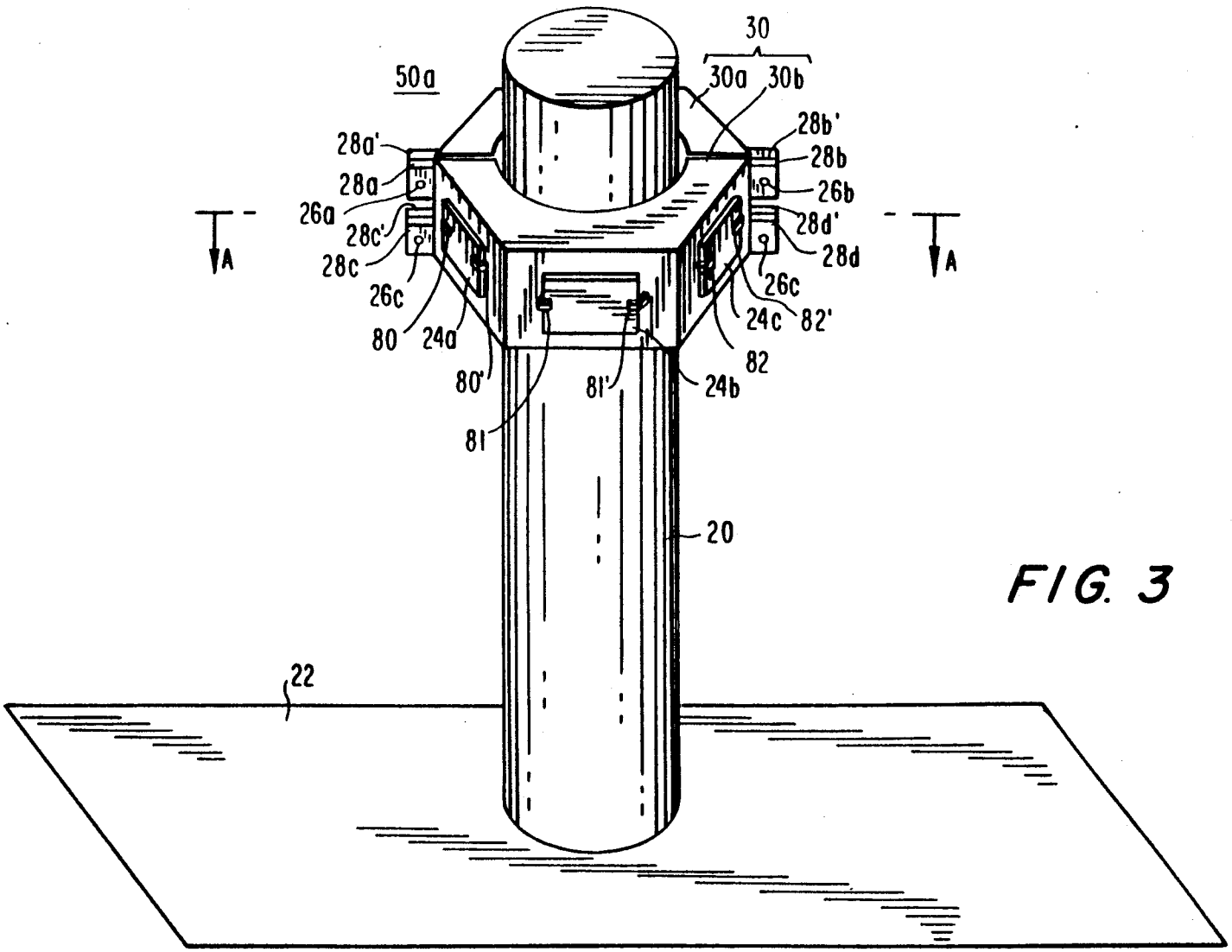
FIG. 3 is a perspective view of a nonmotorized radar antenna system according to a first embodiment of the present invention.
Figure 5:
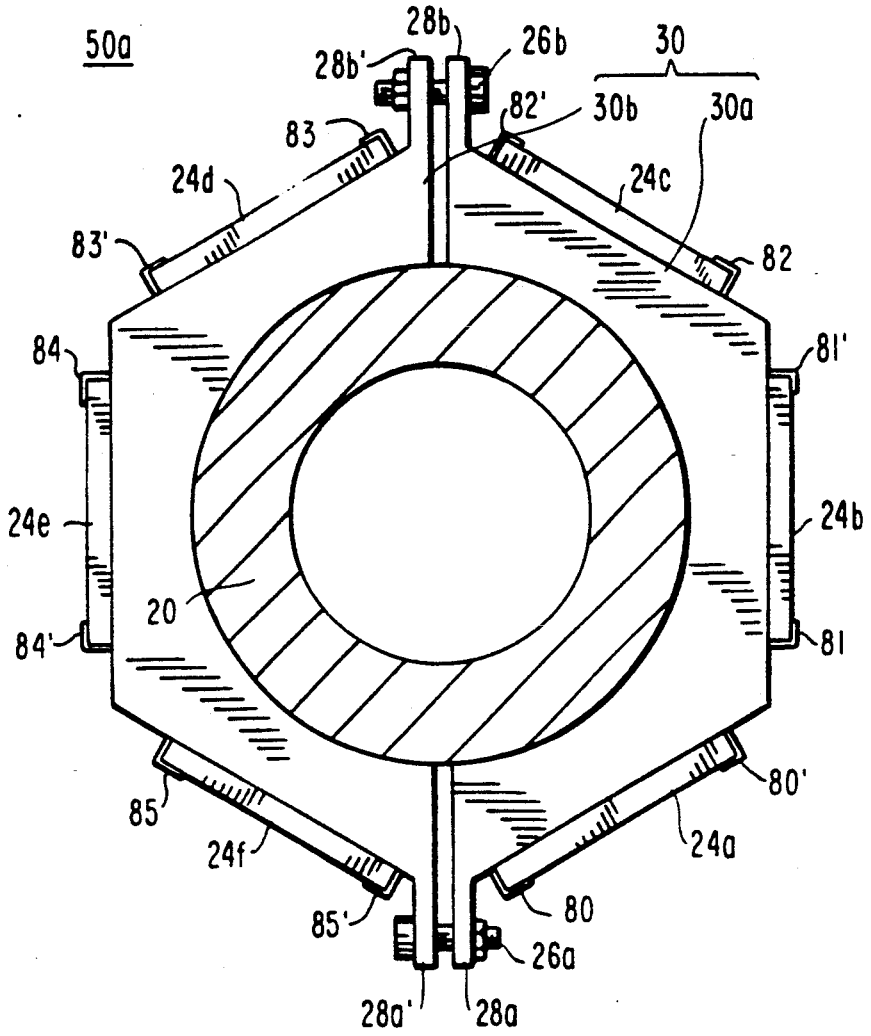
FIG. 5 is a partial cross-sectional view of the nonmotorized radar antenna system shown in FIG. 3 taken through section line A—A.

The general construction of a nonmotorized radar antenna system according to a first embodiment of the present invention is shown in FIG. 3, in which mast 20 is depicted rising above the surface of deck 22. Multi-piece mount 30, formed of a first mount section 30*a* coupled to a second mount section 30*b*, is mounted around mast 20. Multi-piece mount 30 is held to the mast by friction by clamping together sections 30*a* and 30*b* using fasteners 26*a*, 26*b*, 26*c* and 26*d* installed through fastener tabs 28*a*, 28*a*', 28*b*, 28*b*', 28*c*, 28*c*', 28*d*, and 28*d*' or other similar means such as a latch arrangement. Radiating elements 24*a*, 24*b*, 24*c*, 24*d*, 24*e*, and 24*f* are mounted upon the exterior surface of multi-piece mount 30 using dielectric clips 80, 80', 81, 81', 82, 82', 83', 83', 84, 84', 85, and 85', or other suitable mounting means such as adhesive. Radiating elements 24*d*, 24*e*, and 24*f* are shown in FIG. 5. These radiating elements can comprise microstrip antennas, stripline antennas, slotted antennas, or other low profile, lightweight antennas. Coaxial cable, shown schematically in FIG. 10 but not shown in FIG. 3, or some other suitable waveguide is run either inside mast 20 or on its surface and connected to the electronic subsystems of the radar set. This cable, shown schematically in FIG. 10, serves to feed the radiating elements 24*a*, 24*b*, 24*c*, 24*d*, 24*e*, and 24*f*.

Figure 4:
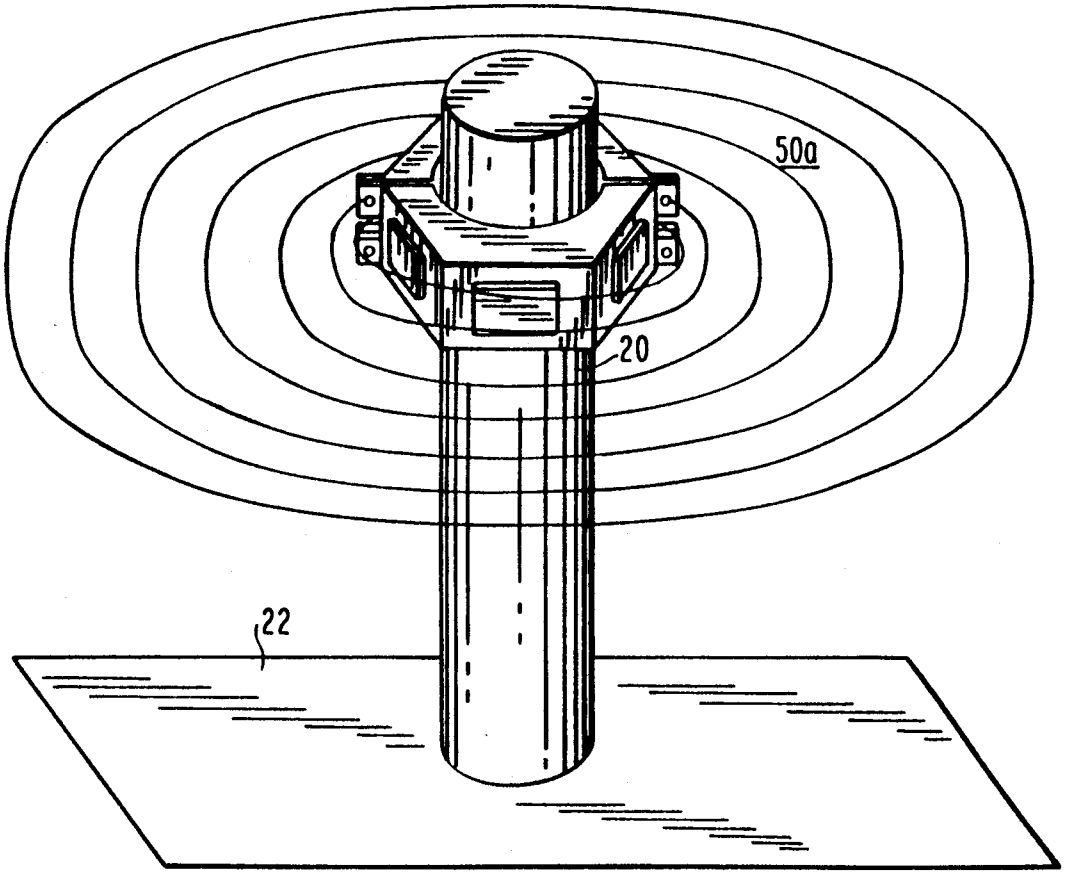
FIG. 4 is a perspective view showing the unobstructed radar coverage provided by the first embodiment of the present invention shown in FIG. 3.

Referring now to FIG. 4, wherein the same reference numerals of FIG. 3 are applied to the same parts and therefore do not require detailed description, it is seen that since the radiating elements are mounted around mast 20, and since the radiating elements radiate radially outward, 360 degree radar coverage is provided by antenna system 50*a* regardless of the presence of mast 20.

In FIG. 5, wherein the same reference numerals of FIG. 3 are applied to the same parts, and therefore do not require detailed description, a partial sectional view of the first embodiment of the present invention is shown.

Figure 6:
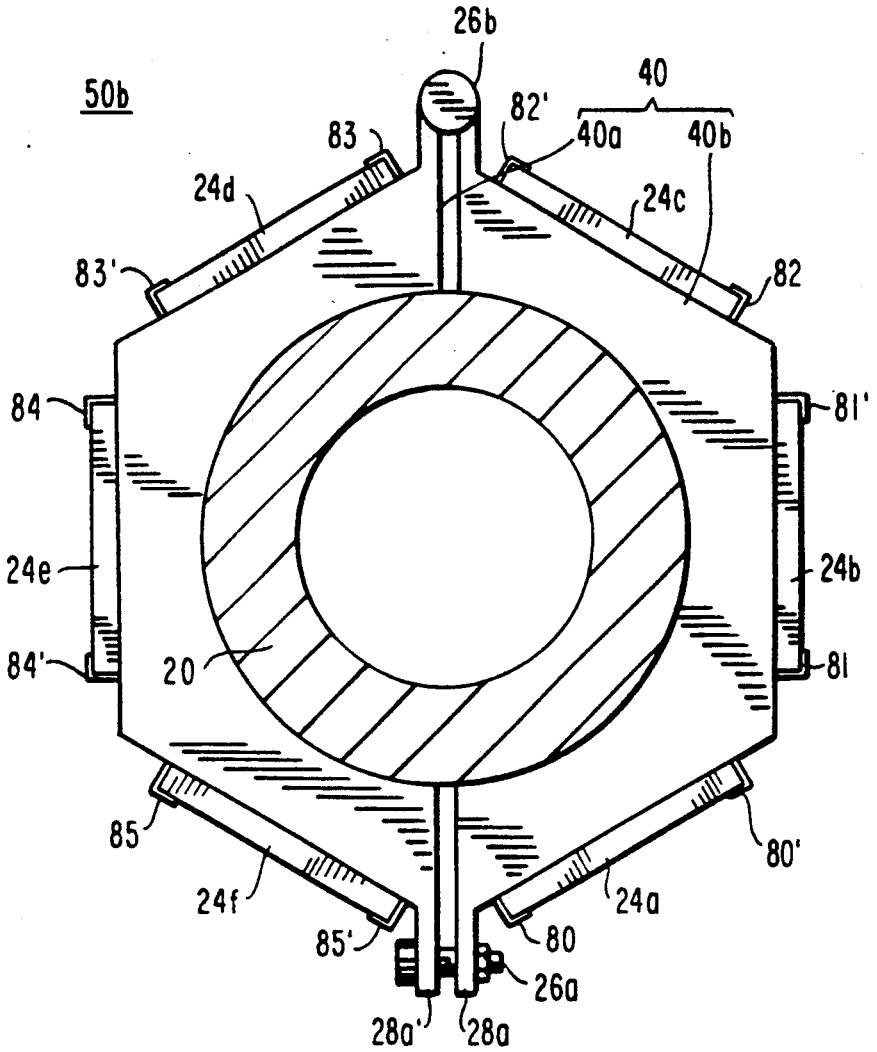
FIG. 6 is a plan view showing a nonmotorized radar antenna system in partial cross section according to a second embodiment of the present invention.

FIG. 6 shows a second embodiment of the present invention, in which the same reference numerals of FIG. 3 are applied to the same parts and therefore do not require detailed description. In this embodiment hinged mount 40 is formed of a first hinged mount section 40*a* and a second hinged mount section 40*b*. Hinged mount 40 is hinged on one side by hinge 26*b*, and is held closed on the opposite side by a suitable closure system, such as fasteners 26*a* and 26*c* securing mounting tabs 28*a* to 28*a*' and 28*c* to 28*c*', respectively. Note, that fastener 26*c* and mounting tabs 28*c* and 28*c*' are not seen in FIG. 6, because they are located below fastener 26*a* and mounting tabs 28*a* and 28*a*'. Alternatively, hinged mount 40 could be held closed by latches or the like. When installed around a mast 20, and when held closed, as described above, hinged mount 40 is held to mast 20 by friction.

Still referring to FIG. 6, which is a plan view showing a nonmotorized antenna system in cross section according to the above-described second embodiment of the present invention, it is seen that because the radiating elements are mounted around mast 20 and radiate radially outward, 360 degree radar coverage is provided by antenna system 50*b* regardless of the presence of mast 20.

Figure 7:
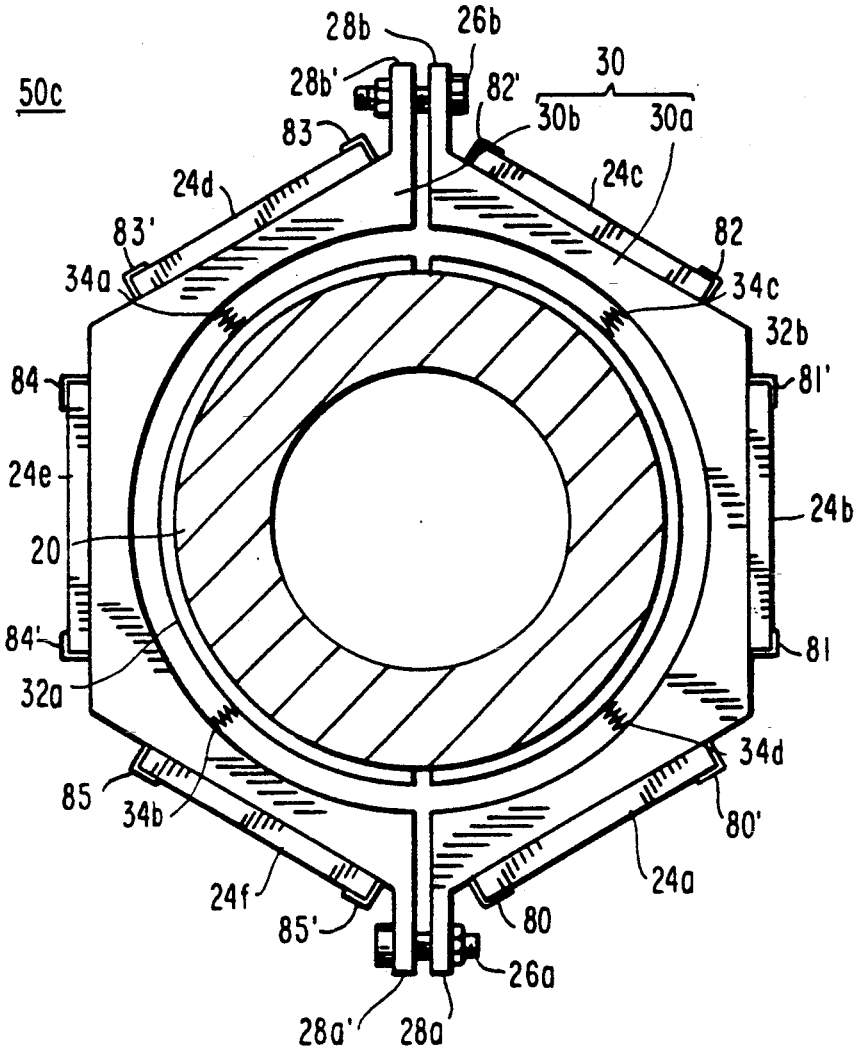
FIG. 7 is a plan view showing a nonmotorized radar antenna system in partial cross section according to a third embodiment of the present invention.

Multi-piece mount 30 of FIG. 3 or hinged mount 40 of FIG. 5 can be either custom designed for each application or can be designed to have a variable inner diameter to facilitate easy mounting on various sized obstructions, as shown in FIG. 7. In this embodiment of FIG. 7, variable support members 34*a*, 34*b*, 34*c*, and 34*d* are attached to arcuate members 32*a* and 32*b*. Variable support members 34*a*, 34*b*, 34*c*, and 34*d* can consist of springs, threaded studs, or the like and provide a means for pushing arcuate members 32*a* and 32*b* radially inward, thus varying the inner diameter of antenna system 50*c*. Arcuate support members 32*a* and 32*b* can be formed in shapes other than symmetrical arcs in order to facilitate mounting of antenna system 50*c* on obstructions with noncircular cross sections.

Figure 8:
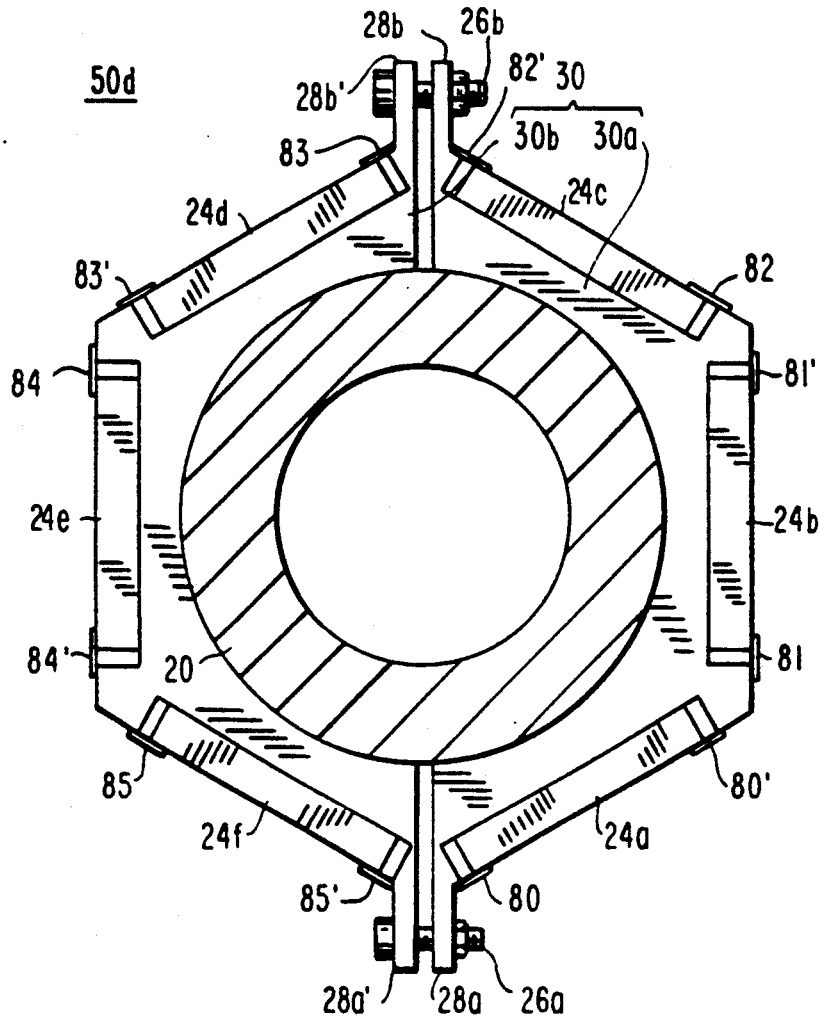
FIG. 8 is a plan view showing a nonmotorized radar antenna system in partial cross section according to a fourth embodiment of the present invention.

In the embodiment shown in FIG. 8, radiating elements 24*a*, 24*b*, 24*c*, 24*d*, 24*e*, and 24*f* are mounted flush with recessed mount 50*d*. Again, as in the other embodiments, the radiating elements 24*a*, 24*b*, 24*c*, 24*d*, 24*e*, and 24*f* are held in place by dielectric clips 80, 80', 81, 81', 82, 82', 83, 83', 84, 84', 85, and 85', or other suitable mounting means such as adhesive. Because the radiating elements are mounted around mast 20 and radiate radially outward, this embodiment also provides 360 degree radar coverage by antenna system 50*d* regardless of the presence of mast 20. Additionally, wind resistance is reduced and the chances of radiating elements 24*a*, 24*b*, 24*c*, 24*d*, 24*e*, and 24*f* getting snagged on a sail, not shown, when antenna system 50*d* is mountd upon a sailboat mast are also reduced.

Figure 9:
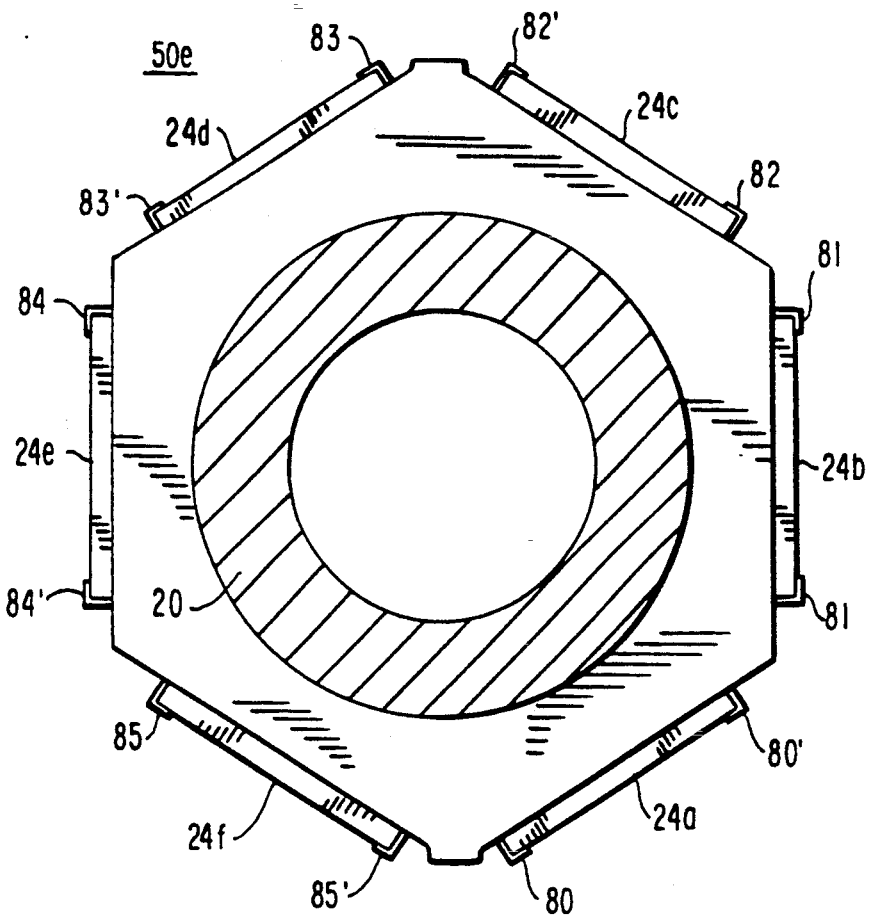
FIG. 9 is a plan view showing a nonmotorized radar antenna system in partial cross section according to a fifth embodiment of the present invention.

In the embodiment shown in FIG. 9, radiating elements 24*a*, 24*b*, 24*c*, 24*d*, 24*e*, and 24*f* are mounted upon one-piece mount 50*e*, which is a unitary mount element with a central hole formed therein. This unitary mount element is fitted over an end of a vertical obstruction such as a sailboat mast and is held in place by friction between the interior of the central hole in the unitary mount element and the exterior of the obstruction. As with the other embodiments of this invention, this embodiment also provides 360 degree radar coverage around a mast or similar obstruction.

Figure 10:
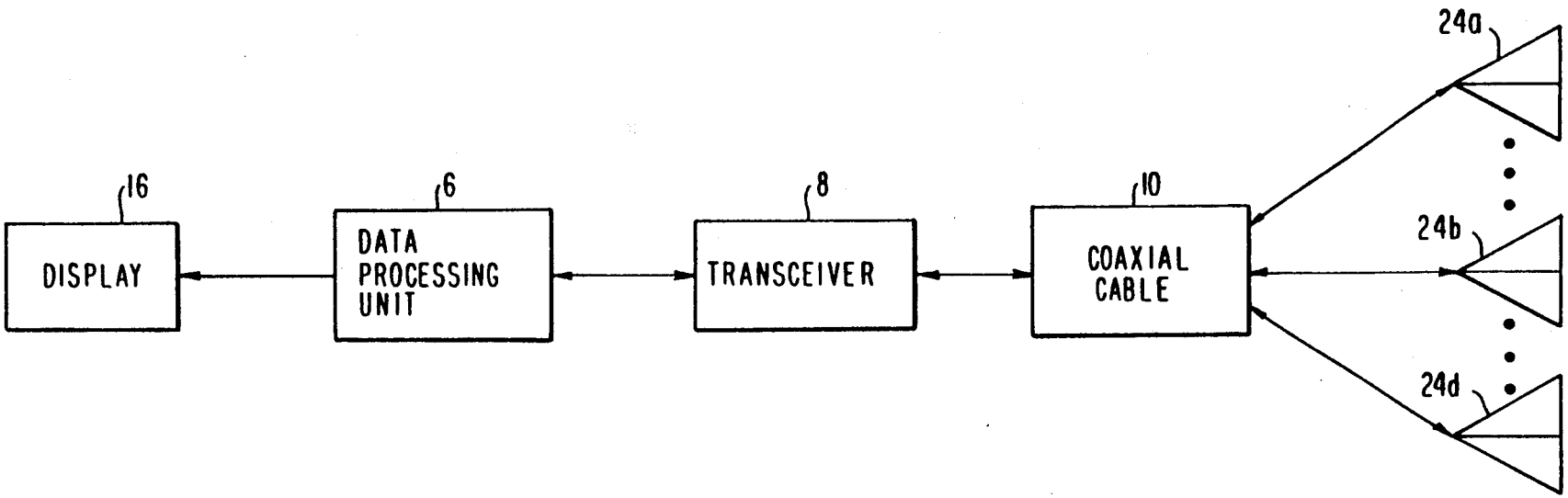
FIG. 10 is a schematic of a radar system according to an embodiment of the present invention.

Operation of the various embodiments described above is identical. The radiating elements 24*a*, 24*b*, 24*c*, 24*d*, 24*e*, and 24*f* are fed an electrical signal through a coaxial cable 10 or other similar waveguide from transceiver 8, as shown in FIG. 10. Further, as depicted in FIG. 10, the inventive antenna system feeds a return signal back to the transceiver 8 through the coaxial cable 10. The feed network employed, such as a corporate feed network or a series feed network, will be a function of the array configuration chosen and the specific power distribution pattern required and need not be discussed here. Likewise the scanning algorithm employed, such as a monopulse algorithm or a sequential lobing algorithm, will also be a function of the array configuration chosen and the specific power distribution pattern required and need not be discussed here either.

There is provided, therefore, a radar antenna unit that does not require the use of a heavy motorized mount, thereby saving weight and resulting in an easier, safer installation. Such weight savings will also result in less rolling of the vessel, because a lighter weight will have been installed at the top of a long lever arm, that is, the mast or the antenna support structure.

The present invention additionally provides a radar antenna unit that does not require the use of a breakdown-prone and electrically noisy motorized mount.

Furthermore, the present invention provides a radar antenna unit that provides unobstructed 360 degree coverage around an obstruction, such as a mast.

Finally, it must be noted that although the present invention is described by reference to particular embodiments thereof, many changes and modifications of the invention may become apparent to those skilled in the art without departing from the spirit and scope of the invention, which is only limited by the appended claims. For example, the radiating elements could be microstrip antennas, stripline antennas, dipoles, slots or horns. Additionally, the number of radiating elements is not limited to the amount represented in the various embodiments. Therefore, the embodiments shown and described are only illustrative, not restrictive.

What is claimed is:

1. A radar antenna apparatus for mounting around a vertical structure comprising:

a plurality of mount sections;

means for attaching said plurality of mount sections to each other around said vertical structure;

said means for attaching said plurality of mount sections to each other around said vertical structure including at least one fastener tab on each end of said plurality of mount sections and at least one fastener for securing together opposing pairs of said fastener tabs, whereby said mount sections are connected to form a central hole therethrough and said radar antenna apparatus is held to said vertical structure by friction between an exterior surface of said vertical structure and interior surfaces of said connected plurality of mount sections;

a plurality of radiating elements;

means for securing said radiating elements to an outer surface of said plurality of mount sections; and means for varying a diameter of said central hole formed in said connected plurality of mount sections, whereby said radar antenna can be mounted upon vertical structures of different cross-sectional sizes;

wherein said means for varying a diameter of said central hole includes a plurality of variable support structures adapted to be mounted upon an inner surface of said plurality of mount sections; and a plurality of arcuate members adapted to be mounted on said plurality of variable support structures, whereby a distance between oppositely facing ones of said plurality of arcuate members is varied and thereby the diameter of said central hole is varied.

2. A radar antenna apparatus for mounting around a vertical structure comprising:

a plurality of mount sections;

means for attaching said plurality of mount sections to each other around said vertical structure;

said means for attaching said plurality of mount sections to each other around said vertical structure including a hinge having portions respectively attached to first ends of two of said plurality of mount sections to form a pivotable joint therebetween, a fastener tab formed on respective second ends of said plurality of mount sections connected by said hinge, and fastener means for securing together opposing pairs of said fastener tabs of said plurality ofmount sections connected by said hinge, whereby said mount sections are connected to form a central hole therethrough and said radar apparatus is held to said vertical structure by friction between an exterior surface of said vertical structure and interior surfaces of said connected plurality of mount sections;

a plurality of radiating elements;

means for securing said radiating elements to an outer surface of said plurality of mount sections; and means for varying a diameter of said central hole formed in said connected plurality of mount sections, whereby said radar antenna can be mounted upon vertical structures of different cross-sectional sizes;

wherein said means for varying a diameter of said central hole includes a plurality of variable support structures adapted to be mounted upon an inner surface of said plurality of mount sections; and a plurality of arcuate members adapted to be mounted on said plurality of variable support structures, whereby a distance between oppositely facing ones of said plurality of arcuate members is varied and thereby the diameter of said central hole is varied.

3. A radar antenna apparatus for providing radar coverage around a sailboat mast comprising:

a unitary collar mount having a central hole formed therein;

a plurality of radiating elements adapted to be mounted around an outer surface of said unitary collar mount, whereby said unitary collar mount is fitted over an end of said sailboat mast and is held to said sailboat mast by friction between an interior surface of said unitary collar mount and an exterior surface of said sailboat mast; and means for varying a diameter of said central hole formed in said unitary collar mount, whereby said radar antenna can be mounted upon vertical structures of different cross-sectional sizes;

wherein said means for varying a diameter of said central hole includes a plurality of variable support structures adapted to be mounted upon an inner surface of said unitary collar mount; and a plurality of arcuate members adapted to be mounted on said plurality of variable support structures, whereby a distance between oppositely facing ones of said plurality of arcuate members is varied and thereby the diameter of said central hole is varied.

* * * * *